US006443161B1

(12) United States Patent
Kaczmarek et al.

(10) Patent No.: US 6,443,161 B1
(45) Date of Patent: Sep. 3, 2002

(54) MAKE-YOUR-OWN CIGARETTE

(75) Inventors: Peter P. Kaczmarek, Richmond Hill (CA); Warren A. Brackmann, Collins, MO (US); Gary Black, Brampton (CA); Cameron Thompson, Aurora (CA)

(73) Assignee: Roths, Benson & Hedges Inc., Ontario (CA)

( * ) Notice: Subject to any disclaimer, the term of this patent is extended or adjusted under 35 U.S.C. 154(b) by 0 days.

(21) Appl. No.: 09/593,688

(22) Filed: Jun. 14, 2000

Related U.S. Application Data

(60) Provisional application No. 60/138,659, filed on Jun. 14, 1999.

(51) Int. Cl.[7] ..... A24D 1/00

(52) U.S. Cl. ..... 131/364; 131/225; 131/347; 131/360; 131/365

(58) Field of Search ..... 131/225, 347, 131/360, 364, 365

(56) References Cited

U.S. PATENT DOCUMENTS 3,628,540 A * 12/1971 Sherrill ..... 131/10.5
4,213,470 A * 7/1980 Horsewell et al. ..... 131/261 B
5,141,000 A * 8/1992 Ruppert et al. ..... 131/77
5,167,241 A * 12/1992 Ruppert et al. ..... 131/70
5,713,377 A * 2/1998 Gerding et al. ..... 131/364
5,749,378 A * 5/1998 Ruppert et al. ..... 131/70
6,206,008 B1 * 3/2001 Matteau et al. ..... 131/361

FOREIGN PATENT DOCUMENTS

| | | |
|---|---|---|
| CA | 1271389 | 7/1990 |
| CA | 2011254 | 9/1990 |
| CA | 2184035 | 2/1998 |
| CA | 2192760 | 2/1998 |

OTHER PUBLICATIONS

English Translation of Gebrauchsmuster G 93 19 938.4.

* cited by examiner

*Primary Examiner*—Christopher A. Fiorilla
(74) *Attorney, Agent, or Firm*—Banner & Witcoff, Ltd.

(57) ABSTRACT

A non-smokeable cigarette unit which may be rendered smokeable by application of a tubular sleeve to the cigarette filter region has a tobacco rod, a filter plug portion and connecting material for connecting the filter plug to the tobacco rod. At least a portion of the periphery of the filter plug is of a sufficient porosity to render the cigarette unit unsmokeable. The filter has a diameter less than the diameter of the tobacco rod. The connecting material bridges a transition from the smaller filter to the larger tobacco rod. This transition portion assists in sliding the sleeve onto the larger tobacco rod to provide a smokeable cigarette.

10 Claims, 2 Drawing Sheets

MAKE-YOUR-OWN CIGARETTE

Benefit of the Jun. 14, 1999 filing date of U.S. provisional application Ser. No. 60/138,659 by the same inventors and entitled "Make-Your-Own Cigarette" is hereby requested.

FIELD OF THE INVENTION

This invention relates to commercially available packaged forms of cigarettes which are non-smokeable in their retail form. The purchased package contains the necessary components which may be applied or manipulated by the smoker to render the non-smokeable cigarette, smokeable.

BACKGROUND OF THE INVENTION

Various types of make your own cigarettes have been available for some time. Many of them function as a substitute for the traditional type of roll-your-own cigarette involving the use of fine cut tobacco and cigarette papers. Many of these devices have worked very well, such as that described in Canadian Patent 1,271,389. This product is directed to the provision of a tobacco rod encompassed in porous paper which renders the product non-smokeable but may be made into a smokeable cigarette by placing the porous wrapped tobacco rod in a cigarette tube which may optionally carry a cigarette filter. Other types of non-smokeable cigarettes which have been directed at modifying the filter end of the cigarette to provide for a non-smokeable feature are described in Canadian Patent 2,011,254; German Gebrauchsmuster G 93 19 938.4; Canadian patent application 2,184,035 and Canadian patent application 2,192,760.

Although these various types of non-smokeable cigarettes have met with varying degrees of commercial success, there continues to be room for improvement in respect of the manner in which the non-smokeable cigarette is made smokeable, particularly in facilitating the user's manipulation of devices to be assembled on the cigarette filter.

SUMMARY OF THE INVENTION

In accordance with an aspect of the invention, various non-smokeable cigarette configurations are provided which can be rendered smokeable by the smoker assembling a tubular sleeve on the cigarette filter area to render the cigarette smokeable. Such aspects of the invention are provided by the use of various cigarette tobacco rod and filter connection systems such as porous tipping paper, porous or non-porous circumferential bands and interrupted tipping papers. All of these systems have in common the feature that the filter portion of the cigarette is modified in some way to provide a nonsmokeable cigarette and the smoker need only to assemble a tubular sleeve to the filter to thereby facilitate conversion of a non-smokeable cigarette to a smokeable product.

According to an aspect of the invention, a non-smokeable cigarette unit which may be rendered smokeable by application of a tubular sleeve to the cigarette filter region has a tobacco rod, a filter plug and connecting material for connecting the filter plug to the tobacco rod. At least a portion of the periphery of the filter plug is of a sufficient porosity to render the cigarette unit unsmokeable. The filter has a diameter less than the diameter of the tobacco rod. The material bridges a transition from the smaller filter to the larger tobacco rod whereby the transition portion of the material assists in sliding the sleeve onto the larger tobacco rod to provide a smokeable cigarette.

According to another aspect of the invention, a method for producing a non-smokeable cigarette unit comprises attaching with connecting material a filter plug to a tobacco rod where the filter plug has a diameter smaller than the diameter of the tobacco rod. The connecting material defines a transition portion from the smaller filter to the larger tobacco rod.

BRIEF DESCRIPTION OF THE DRAWINGS

Preferred embodiments of various aspects of the invention are shown in the drawings wherein.

DETAILED DESCRIPTION OF THE PREFERRED EMBODIMENTS

Figure 1:
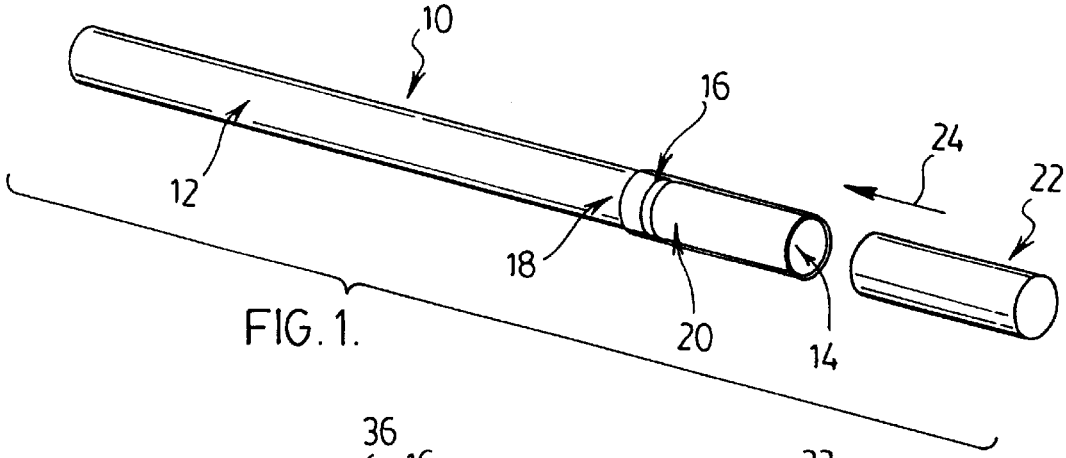
FIG. 1 is a perspective view of a first embodiment of the invention where the filter portion is connected to the tobacco rod by use of a porous tipping paper and a tubular sleeve is slid over the porous tipping paper to render the cigarette smokeable.

In the drawings various aspects of the invention comprising non-smokeable cigarettes which may be rendered smokeable by the user are shown. What is common to each aspect of the invention is that the portion of the cigarette which is modified to render it non-smokeable is the filter portion. The user then uses components supplied with the non-smokeable cigarette to cover up or seal the modification to make it smokeable.

With reference to FIG. 1, the non-smokeable cigarette 10 has the usual tobacco rod portion 12 and filter plug portion 14. In this particular embodiment, the filter plug 14 is secured to the tobacco rod 12 by way of a tipping paper 16 which is highly porous in the manner described, for example in the above German application. The tipping paper may be rendered porous by forming holes in the paper or using a porous wrapper in the manner taught in this German reference. In accordance with an aspect of this invention, the porous tipping paper has the physical characteristics which preferably prevents the glue, which affixes the porous tipping material to the tobacco rod end designated 18 to the filter plug end designated 20, from bleeding through the porous material and gumming up the cigarette manufacturing machines. For example, porous filter plug wrap works very well in this application, although it is understood that other porous types of sheet or paper may be used. With this arrangement the highly porous tipping material 16 prevents someone from lighting and smoking the cigarette 10. When the user puffs on this type of non-smokeable cigarette, principally all of the air drawn by the smoker passes through the porous filter rather than along the length of the tobacco rod. Hence, the smoker is not able to draw sufficiently on the cigarette to light the cigarette in a normal manner.

In order to render the cigarette 10 smokeable, a tubular sleeve 22 is slid over the porous tipping material 16 in a direction of arrow 24. The tubular sleeve 22 has an internal dimension which allows sliding of the sleeve over the porous tipping material but at the same time is sufficiently snug around the porous material to effect a seal so that one may now light and smoke the assembled cigarette. It is appreciated that the snugness of the fit may vary somewhat depending on the choice of materials. It has been found for most applications, that a difference in the inner diameter of the sleeve and the outer diameter of the cigarette portion over which the sleeve slides should be in the range of about 1/20 to 3/10 of a mm. This difference in dimension is usually sufficient to permit sliding of the sleeve onto the cigarette without distorting the sleeve or the cigarette and at the same time sealing the cigarette filter.

Figure 2:
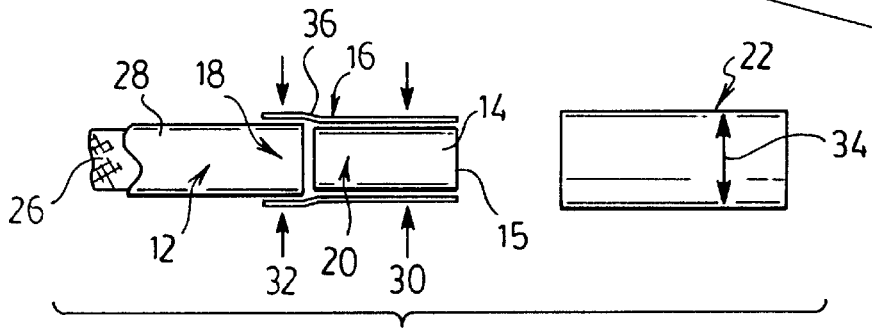
FIG. 2 is an enlarged section of the cigarette of FIG. 1 showing the relative sizes of the tobacco rod and the filter portion in accordance with the preferred embodiment thereof.

Further details of the construction are shown in FIG. 2. The tobacco rod 12 comprises the usual inner tobacco portion 26 surrounded by the normal cigarette paper 28. The porous tipping material 16 which connects the filter plug 14 to the tobacco rod 12 extends the length of the filter from end 15 and over part of the tobacco rod. It is appreciated that the filter plug 14 may be of the same diameter as the tobacco rod 12 and correspondingly, the sleeve 22 may have a diameter in accordance with above prescribed dimensions which fits readily over the porous material 16. In accordance with a preferred aspect of the invention, it has been found that by making the filter plug 14 slightly smaller than the tobacco rod, significant benefits arise when placing the sleeve 22 over the porous tipping 16. As shown in FIG. 2 this preferred embodiment has the diameter 30 of the porous wrapped filter 14 slightly less than the diameter 32 of the porous wrapping on tobacco rod 12. The inner diameter 34 of the sleeve 22 is dimensioned to fit snugly over the diameter 32 of the porous wrapping 16 connected to the tobacco rod end 18. Hence, the sleeve 22 readily slides over the porous wrapped filter plug portion 20 and encounters the sloping portion 36 which bridges the transition from the smaller filter 14 to the larger tobacco rod 12. This transition or sloping portion 36 facilitates slipping of the tube 22 onto the slightly enlarged portion identified by diameter 32. The difference between the diameters 34 and 32 ensures a snug fit and a securement of the sleeve in place.

Figure 3:
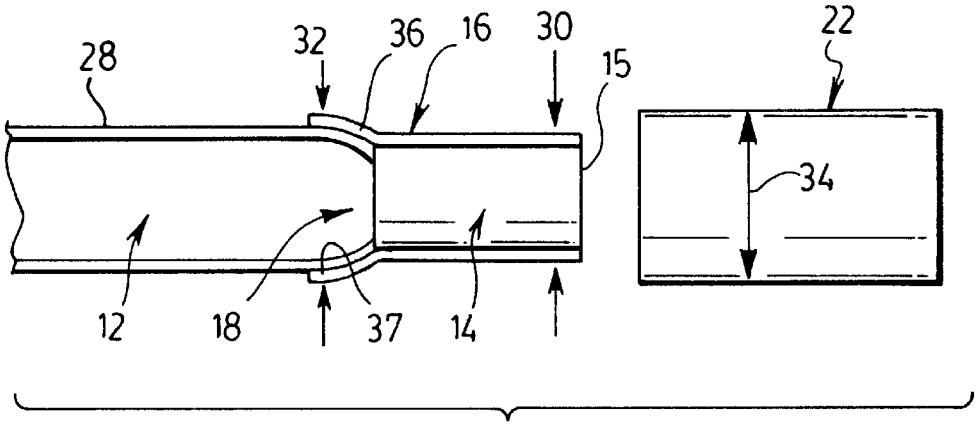
FIG. 3 is an enlarged section of an alternative embodiment of FIG. 2.

An enhancement to the arrangement of FIG. 2, is shown in the enlarged section of FIG. 3. The filter plug 14 is attached to the tobacco rod 12 by tipping paper 16. The tipping paper 16 slightly compresses the tobacco rod end 18 and tapers it to a reduced diameter approximating that of the filter plug 14. A sleeve 22 is provided for slipping over the porous tipping 16. With this embodiment, the outside diameter 30 for the porous wrapped filter plug 14, the outside diameter 32 for the porous wrapped tobacco rod end and the inside diameter 34 for the internal diameter of the sleeve 22 may be varied somewhat from that described with respect to FIG. 2. The difference in the diameter of the wrapped tobacco rod and the wrapped porous filter plug may vary appreciably as long as the diameter 30 is considerably less than diameter 34. The difference in diameters may be appreciable, usually in excess of 0.15 mm and considerably more, for example, in the range of 0.2 to 0.4 mm. Normally the porous wrap overlaps at 37, the tobacco rod end 18 by about 4 mm.

The sloped or transition portion 36 of the porous wrap which leads from the filter plug 14 to the tobacco rod end 18, slopes outwardly to provide a ramp for centering and guiding the slipping of the sleeve over the ramp 36 and onto the overlapping portion 37 of the porous wrap. By virtue of the ramp 36, the internal diameter for the sleeve 22 may be identical to or slightly less than the outer diameter 32 of porous portion 37. Due to the ramp portion 36 the sleeve 22 can stretch and/or compress slightly the tobacco end portion 18 so as to provide an interference fit onto the flatter portion 37 and thereby seal the sleeve as it overlays and seals the porous wrapped filter 14. It is also understood that the user could also during the assembling process, pre-compress the tobacco end 18 to facilitate further slipping the sleeve 22 onto the flatter portion 37.

This system greatly facilitates manufacturing tolerances. The filter plug 14 may be of a diameter which is less than the lower end of the design tolerances for the sleeve 22, to readily facilitate slipping of the sleeve over the porous wrapped filter plug. The internal diameter of the sleeve, in being identical to the outside diameter of porous portion 37 is acceptable because when the sleeve is on the lower side of manufacture tolerances and/or the outer diameter 32 is on the maximum side of the tolerances, the sleeve 22 will still slip over portion 37 due to the effect of the ramp 36 centering and guiding the advance of the sleeve. This procedure greatly enhances the sealing of the porous wrapped filter at the tobacco end 18. Any space between the internal diameter 22 of the sleeve and the porous wrapped filter plug 14 at the filter end 15 is sealed by the smoker's mouth and the product is then rendered smokeable. By virtue of this ramp or transition portion 36, it is understood that the dimensions for the wrapped portion of the tobacco rod relative to the internal dimension of the sleeve may vary somewhat from the previously prescribed range of about 1/20 to 3/10 of a millimetre. In slipping the sleeve over portion 37 instead of the prescribed minimum of 1/20 of a millimeter, one may design for the same diameter or for that matter, slightly less to provide a very snug fit. This will depend somewhat on the resiliency of the sleeve and of the tobacco end 18. It is appreciated that in making the internal diameter of the sleeve the same as the external diameter 32 of the wrapped tobacco rod end, there will be at times a negative tolerance but again this is readily accommodated by the ramp portion 36 stretching and/or compressing the tobacco to provide an interference fit.

Figure 4:
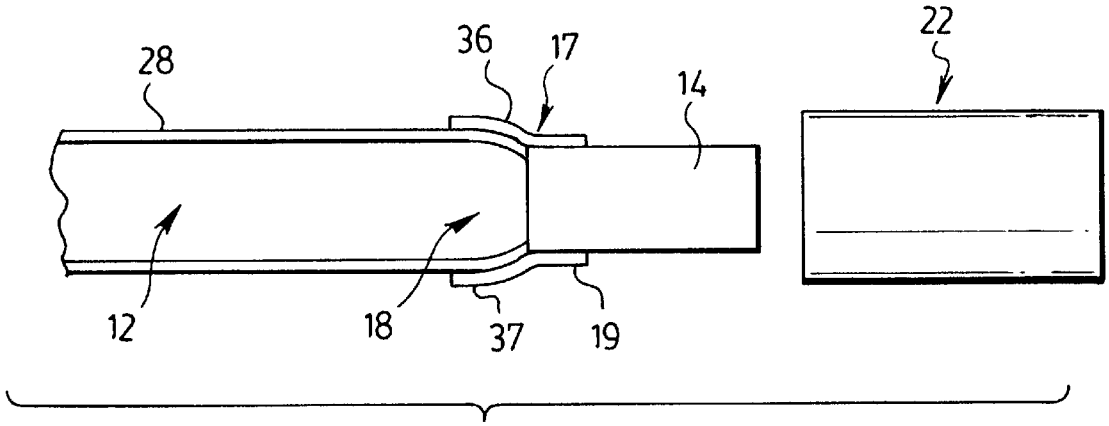
FIG. 4 is an enlarged section of another alternative embodiment of FIG. 2.

An alternative to the design of FIG. 3 can be found in FIG. 4. Instead of using tipping paper 16, which extends the full length of the filter and usually about 4 mm up on to the tobacco rod 12, a circumferential band 17 may be used, as shown in FIG. 12, to achieve the attachment of the porous wrapped filter 14 to the tobacco rod 12. The circumferential band 17 bridges the difference in outside diameters of the filter 14 and the tobacco rod end 18 in the same manner as the extended length of tipping paper 16 of FIG. 3. As a result, the circumferential band provides a ramp or transition portion 36 and the flatter portion 37 such that when the sleeve 22 is slid onto the cigarette, it readily slides over the reduced portion 19 of the circumferential band and then the ramp 36 centers and guides and sleeve up onto the flat portion 37 to complete assembly and provide a smokeable cigarette in the same manner as described with respect to FIG. 3.

Figure 5:
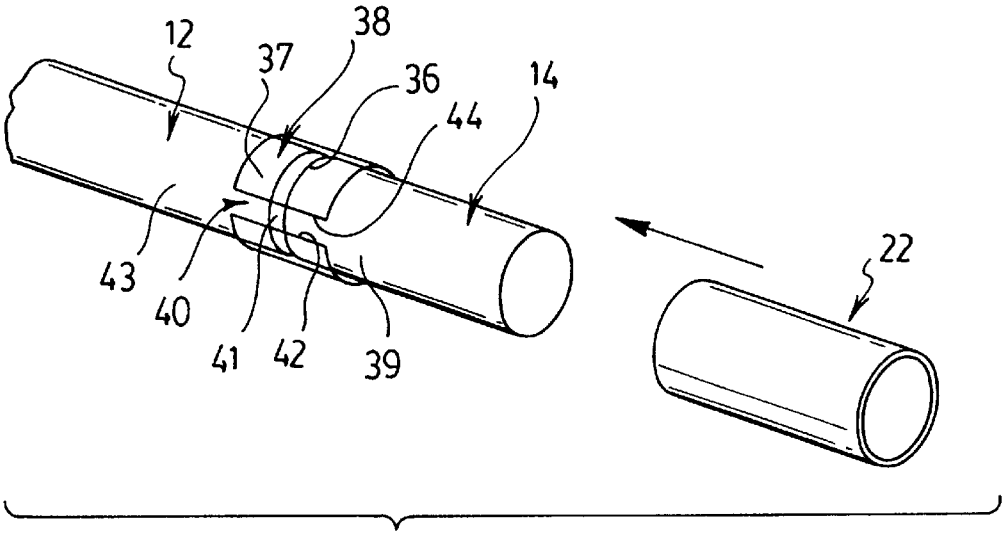
FIG. 5 shows yet another aspect of the invention where a circumferential band for connecting cigarette filter to tobacco rod is interrupted.

It is appreciated that various configurations may be used to modify the structure of the filter end of a cigarette to provide a non-smokeable unit. Such an alternative is shown in FIG. 5. The usual tobacco rod 12 is connected to the usual filter plug 14 by a circumferential band 38 which only partially surrounds the periphery 43 of the tobacco rod and the periphery 39 of the filter plug to leave a gap 40 between the spaced apart ends 42 and 44 of the band 38. As with the earlier embodiments, the band in bridging the differences in diameters of the filter plug 14 and the tobacco rod 12 provides the usual ramp portion 36. The filter plug 14 may be wrapped in a non-porous filter material. With that embodiment the gap 40 provides a non-smokeable cigarette because air can then enter the space 41 between the filter plug 14 and the tobacco rod 12. It is also appreciated that the filter plug 14 may be wrapped in a porous material and that a non-porous connecting band 38 may be used which extends the length of the filter plug. A gap 40 is then provided along the length of the filter plug to provide at least a portion thereof which is of sufficient porosity to provide a non-smokeable cigarette unit. Accordingly, with this embodiment, at least a portion of the periphery of the filter plug may be porous to provide a non-smokeable unit. This portion of the periphery of the filter plug includes an arrangement where a slight gap 41 between the tobacco rod and filter plug provides sufficient flow of air to give a nonsmokeable cigarette unit.

To render the cigarette unit smokeable a sleeve 22 dimensioned to slide over the circumferential band 38 is provided. Once the tubular band 22 is slid over the ramp portion 36 to complete covering of the band 38 the cigarette unit is rendered smokeable.

By virtue of the ramp portion 36, the sleeve need not be perfectly round. The sleeve may have a somewhat oval perimeter shape with narrow side portions. This allows the user to gently squeeze side portions towards one another so that the sleeve assumes a somewhat circular shape. In view of the significant difference between the outside diameter of the filter and the inside diameter of the sleeve when its squeezed, it will readily fit on to the filter portion. The ramp 36 then centers, expands and forces the sleeve into a round shape so as to slide up onto the flatter portion 37. By virtue of the sleeves being somewhat flattened, or for that matter, completely flattened, a more compact packaging arrangement may be used because the sleeves take up less space. Furthermore, the ramp portion 36 facilitates the use of slightly damaged sleeves. With the prior art systems there is always a problem that slightly damaged sleeves could not be used. The ramp portion 36 facilitates the use of slightly damaged sleeves because of the significant difference in the outside diameter of the filter plug and the outside diameter of the filter plug and the inside diameter of the sleeve where such difference may be in the range of about 0.15 to 0.4 mm difference in diameter. Also, another feature of the ramp design is that the sleeves are never too loose. This was another problem with the prior art designs where, due to manufacturing tolerances, the sleeve might end up being too large for a particular cigarette. On the other hand, with this invention, the preferred zero tolerance in the dimension between the internal diameter of the sleeve and the flatter portion 37 avoids the loose sleeve problem.

As is apparent from a discussion of these various embodiments of the invention, the retail form of the cigarette is non-smokeable by virtue of modifying some aspect of the filter portion. It is appreciated that variations may be made to these various aspects of the invention without departing from the spirit of the invention.

What is claimed is:

1. A non-smokeable cigarette unit which may be rendered smokeable by application of a tubular sleeve to a cigarette filter region, said non-smokeable cigarette unit has a tobacco rod, a filter plug and connecting material for connecting said filter plug to said tobacco rod, at least a portion of the periphery of said filter plug being of a sufficient porosity to render said cigarette unit unsmokeable, said filter plug having a diameter less than the diameter of said tobacco rod at a position adjacent said tobacco rod, said connecting material bridging a transition from said smaller filter to said larger tobacco rod whereby said transition portion of said material assists in sliding said sleeve onto a portion of said larger tobacco rod to secure said sleeve to the larger tobacco rod and complete application of said sleeve to said cigarette filter region to provide a smokeable cigarette.

2. A non-smokeable cigarette unit of claim 1, wherein said connecting material is porous tipping paper.

3. A non-smokeable cigarette unit of claim 1, wherein said porous tipping paper extends the length of said filter plug.

4. A non-smokeable cigarette unit of claim 1, wherein said connecting material is a circumferential band attaching adjacent portions of said filter plug and said tobacco rod.

5. A non-smokeable cigarette unit of claim 4, wherein said circumferential band is non-porous and said filter plug is wrapped in porous material.

6. A non-smokeable cigarette unit of claim 5, wherein said sleeve is resilient to facilitate slipping said sleeve over said transition portion and onto said tobacco rod.

7. A non-smokeable cigarette of claim 4, wherein said band partially surrounds said tobacco rod and said filter plug to provide a gap between band ends, said gap providing said portion with sufficient porosity.

8. A non-smokeable cigarette unit of claim 1, wherein said connecting material is non-porous and extends from the tobacco rod to a free end of said filter plug, said connecting material being a band which partially surrounds said tobacco rod and filter plug to provide a gap between band ends, said gap providing said portion of sufficient porosity.

9. A non-smokeable cigarette unit of claim 1, wherein a difference in the diameter between said tobacco rod and said filter plug is in excess of 0.15 mm.

10. A non-smokeable cigarette unit of claim 9, wherein said sleeve has an inner diameter at least about 1/20 mm greater than the diameter of said tobacco rod.

* * * * *